US005989097A

United States Patent [19]

Lebedz

[11] Patent Number: 5,989,097

[45] Date of Patent: Nov. 23, 1999

[54] GUIDE STICK AND HOOP TOY

[76] Inventor: Nicholas Lebedz, 100 - 13th St., Belleair Beach, Fla. 33786

[21] Appl. No.: 09/270,335

[22] Filed: Mar. 16, 1999

[51] Int. Cl.[6] ..... A63H 33/02

[52] U.S. Cl. ..... 446/450; 446/411

[58] Field of Search ..... 446/409, 411, 446/431, 450, 451, 452, 453

[56] References Cited

U.S. PATENT DOCUMENTS

| | | | |
|---|---|---|---|
| 2,861,389 | 11/1958 | Baker | 446/411 |
| 2,984,937 | 5/1961 | Rendon | 446/450 |
| 3,001,324 | 9/1961 | Walker | 446/450 |
| 3,001,325 | 9/1961 | Riccobono | 446/450 |
| 3,233,361 | 2/1966 | Conaghan | 446/411 |
| 3,464,149 | 9/1969 | Batterson et al. | 446/411 |
| 3,676,951 | 7/1972 | Shearer | 446/411 |
| 4,091,564 | 5/1978 | Jasinski . | |
| 4,102,077 | 7/1978 | Marino . | |
| 4,173,841 | 11/1979 | Hensley | 446/453 |
| 4,257,189 | 3/1981 | Hensley | 446/138 |
| 4,453,341 | 6/1984 | Klukos | 446/450 |
| 4,682,971 | 7/1987 | Washington . | |
| 4,799,917 | 1/1989 | Lentz . | |
| 4,913,677 | 4/1990 | Brasier et al. . | |
| 5,299,970 | 4/1994 | Fontaine | 446/453 |

*Primary Examiner*—Sam Rimell

[57] ABSTRACT

Disclosed is a guide stick and hoop toy amusement apparatus for use by children. The apparatus consists of a hoop element which is adapted to be rolled upon the ground by the user. The second component of the apparatus is the stick. The stick consists of a first handle end and a second guide channel end. The guide channel has a radius of curvature which is specifically adapted to engage the outer circumference of the hoop element.

9 Claims, 3 Drawing Sheets

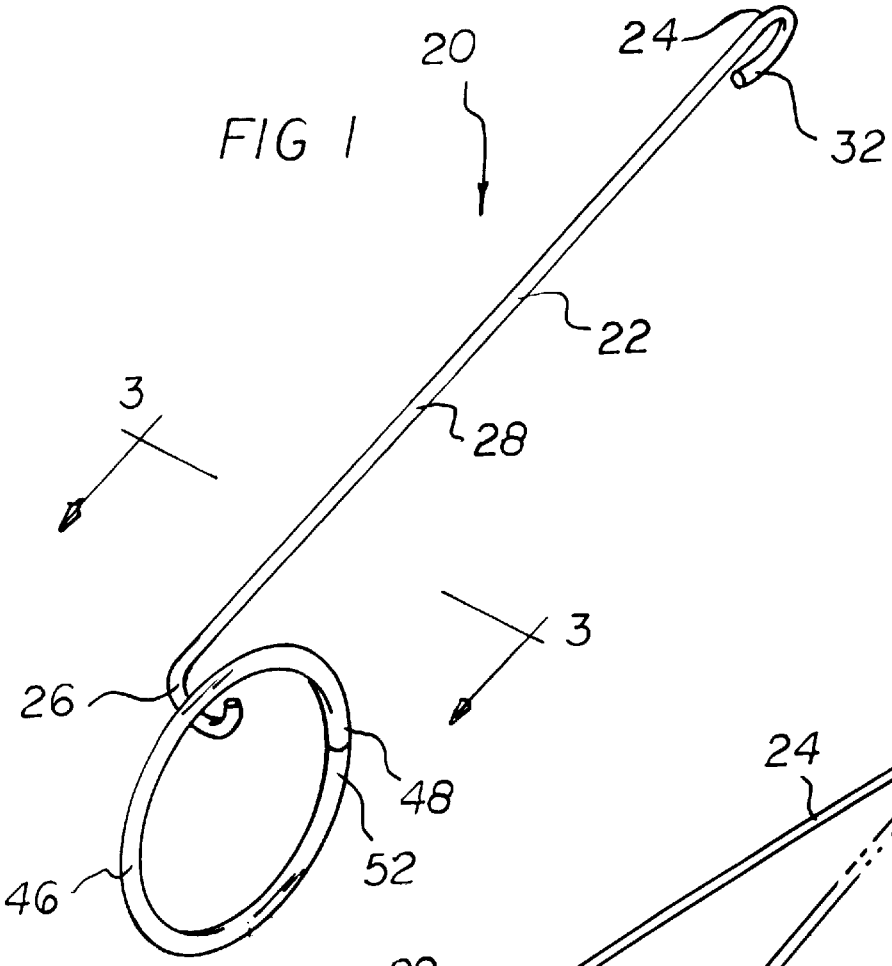
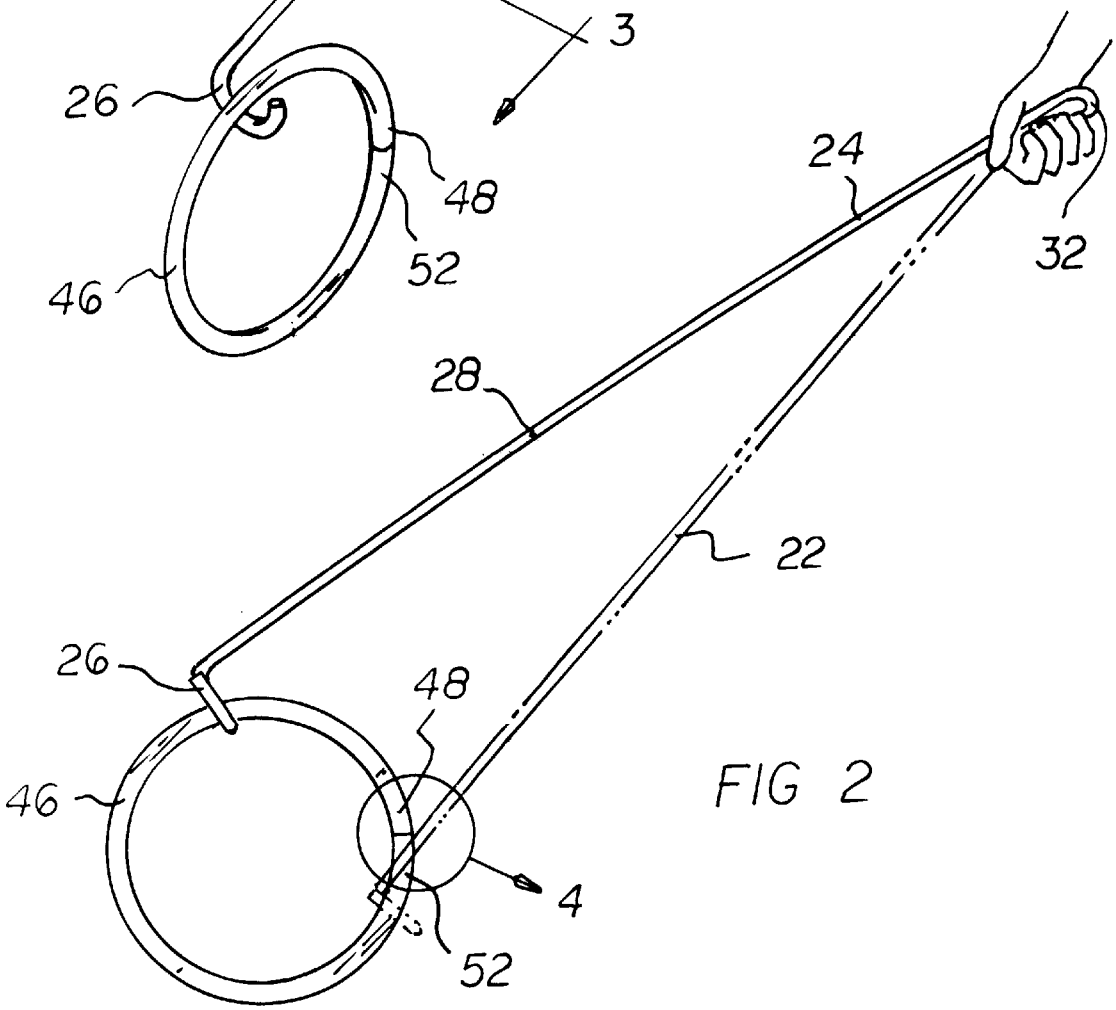
FIG 2

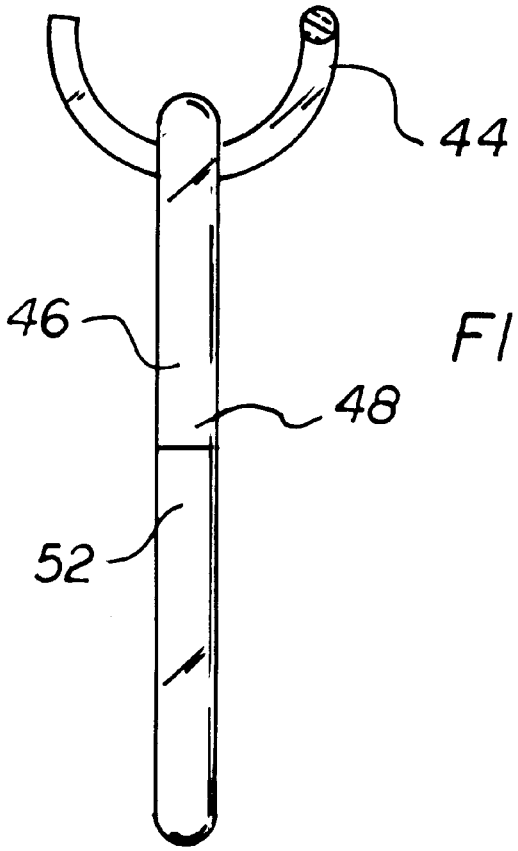
FIG 3
FIG 4
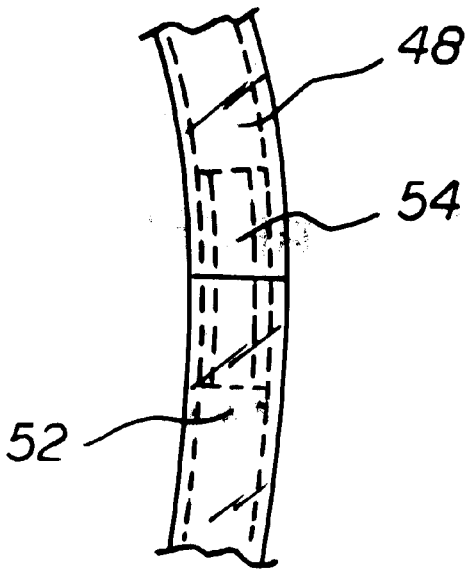

GUIDE STICK AND HOOP TOY

BACKGROUND OF THE INVENTION

1. Field of the Invention

The present invention relates to a new and improved amusement apparatus for use by children and adults. The apparatus allows the user to employ a rod to impart continuous rotational movement to a hoop which is adapted to roll upon the ground.

2. Description of the Prior Art

The use of hoop and guide sticks are known in the prior art. More specifically, such hoop and guide stick toys heretofore devised are known to consist basically of familiar, expected, and obvious structural configurations, notwithstanding the myriad of designs encompassed by the crowded prior art which has been developed for the fulfillment of countless objectives and requirements.

For example, U.S. Pat. No. 4,913,677 to Brasier illustrates a hoop toy and guide stick for use as an amusement device. This device employs an elongated stick with a centrally located rectangular element at its lower extent. Such rectangular element is for use in guiding the hoop. This prior art device, however, fails to teach or suggest several inventive features of the present invention.

The construction of this prior art device fails to give the user complete control over the hoop element. Furthermore, the stick of the prior art device cannot be easily formed from a single length of material. Lastly, the rectangular element of the prior art device does not provide for a perfect mating relation with the hoop element.

Therefore, it can be appreciated that there exists a continuing need for a new and improved amusement apparatus for use by children. In this regard, the present invention substantially fulfills this need.

SUMMARY OF THE INVENTION

In view of the foregoing disadvantages inherent in the known types of hoop and stick toys now present in the prior art, the present invention provides a new and improved amusement apparatus for use by children. As such, the general purpose of the present invention, which will be described subsequently in greater detail, is to provide a new and improved amusement apparatus for use by children wherein greater control over the hoop element can be achieved.

To attain this, the present invention essentially comprises an apparatus adapted to be manipulated by a user. Such apparatus comprises a two-part guide stick. The stick is formed from a length of translucent acrylic material and has a ⅜ inch diameter. The guide stick is also between two and three feet in length and is defined by a longitudinal axis, a first end, a second end, and an intermediate extent therebetween. The guide stick material thus permits flexibility between the first and second ends. The first end is folded over within a plane and is formed into an elongated closed loop of three inches in length. The intermediate extent has an internal connection piece releasably coupling the two parts of the guide stick. The two parts are of substantially equal length. The second end is formed into a semi-circular guide channel of a first radius. The guide channel being completely offset from the intermediate extent of the guide stick, whereby the guide channel is offset to the user's left side when the guide stick is in use. The guide channel is also contained within a plane, the plane of the guide channel being slightly offset from the longitudinal axis of the stick.

The plane of the guide channel is angled with respect to the plane of the closed loop. The hoop element of the present invention is formed from a length of clear Tygon tubing. The tubing has first and second ends which are releasably coupled by a smaller piping element. With the two ends interconnected, a closed loop with a second radius is formed. The first and second radii are selected such that the guide channel of the guide stick can support the hoop as well as be employed to imparting rotary motion to the hoop.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved amusement apparatus for use by children wherein the hoop controlling element is offset from the longitudinal axis of the remainder of the stick.

It is another object of the present invention to provide a new and improved amusement apparatus for use by children which may be easily and efficiently manufactured. Specifically, the stick element is capable of being formed from a continuous cylindrical length.

It is a further object of the present invention to provide a new and improved amusement apparatus for use by children wherein the radius of the hoop controlling element and the radius of the hoop are selected to provide for optimal control.

An even further object of the present invention is to provide a new and improved amusement apparatus for use by children which is susceptible of a low cost of manufacture with regard to both materials and labor, and which accordingly is then susceptible of low prices of sale to the consuming public, thereby making such a amusement apparatus for use by children economically available to the buying public.

Even still another object of the present invention is to provide a hoop and stick toy wherein each of the elements is formed from a transparent material.

Lastly, it is an object of the present invention to provide a guide stick and hoop toy amusement apparatus for use by children. The apparatus consists of a hoop element which is adapted to be rolled upon the ground by the user. The second component of the apparatus is the stick. The stick consists of a first handle end and a second guide channel end. The guide channel has a radius of curvature which is specifically adapted to selectively engage either the inner or outer circumference of the hoop element. In this manner, the stick can be employed in both supporting the hoop element and imparting rotation motion thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the amusement apparatus for use by children constructed in accordance with the principles of the present invention.

FIG. 2 is a side elevational view of the apparatus as shown in FIG. 1.

FIG. 3 is a top elevational view taken at line 3—3 of FIG. 1.

FIG. 4 is a cross-sectional view as shown in circle 4 of FIG. 2.

The same reference numerals refer to the same parts throughout the various Figures.

DESCRIPTION OF THE PREFERRED EMBODIMENT

Figure 5:
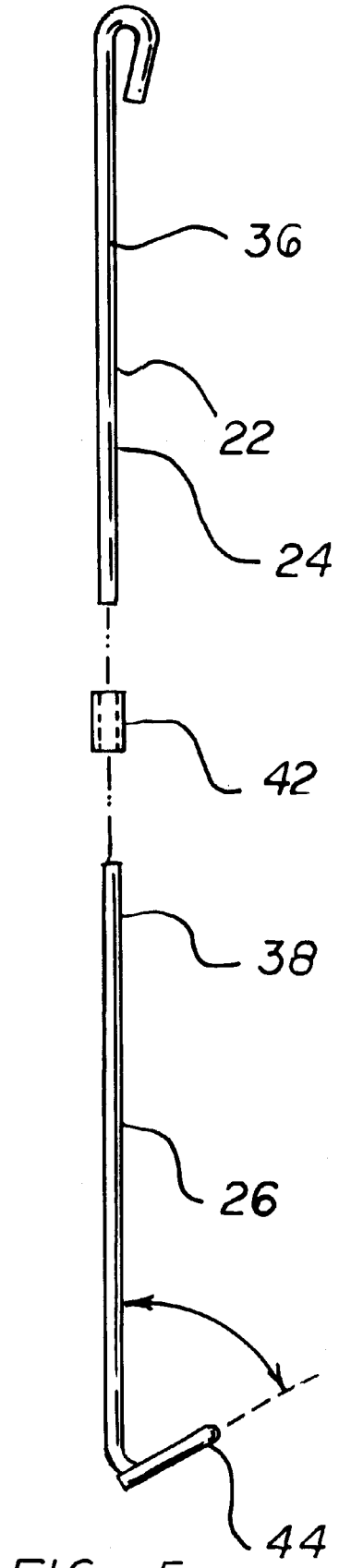
FIG. 5 is a side elevational view of the guide stick of the present invention shown broken apart.

With reference now to the drawings, and in particular to FIGS. 1 through 6 thereof, the preferred embodiment of the new and improved guide stick and hoop toy amusement apparatus for use by children embodying the principles and concepts of the present invention and generally designated by the reference numeral 20 will be described.

The present invention relates to a new and improved amusement apparatus for use by children. The apparatus allows the user to employ a rod to impart continuous rotational movement to a hoop which is adapted to roll upon the ground. More specifically, the apparatus is comprised of a guide stick with a first handle end and a second end formed into a guide channel. This guide channel is specifically adapted to selectively engage either the inner or outer periphery of the hoop. In this manner, the guide channel can both support and provide rotational movement to the hoop. The various components of the apparatus of the present invention, and the manner in which they interrelate, will be described in greater detail hereinafter.

The guide stick 22 is preferably formed by extruding a length of translucent acrylic material. This results in a stick formed from a single material. In the preferred embodiment, the stick 22 has a width of ⅜ inch. Other materials, both opaque and translucent, could likewise be employed in forming the stick 22. Whichever material is employed, it should be capable of being extruded. The guide stick 22 should be between two and three feet in length to accommodate its use by a child user. In the preferred embodiment, the stick is 32 inches in length. The guide stick 22 is defined by a longitudinal axis, a first end 24, a second end 26 and an intermediate extent 28 therebetween. Whatever material is employed in constructing the guide stick 22, it should be sufficiently flexible to allow the stick 22 to bend or flex between its first and second ends (24 and 26 respectively).

The first end 24 of the guide stick 22, in the preferred embodiment, is folded over in a plane and formed into an elongated closed loop 32 of three inches in length. This closed loop 32 can be seen with reference to FIG. 5. In an alternative embodiment, the first end 24 is not folded over, but rather capped by a handle element 34. This embodiment is illustrated in FIG. 6. The handle 34 of this embodiment is preferably formed from rubber, plastic, styrofoam, wood or any other desired material.

Figure 6:
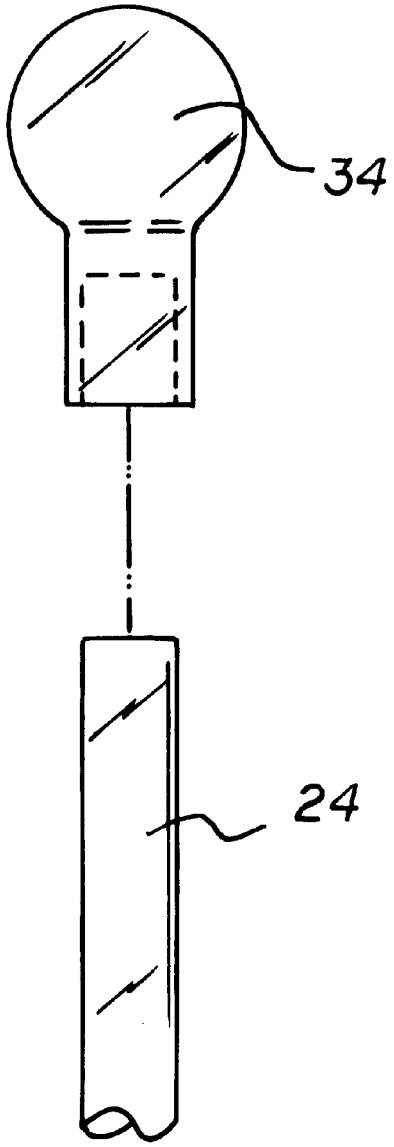
FIG. 6 is a view of the detachable handle embodiment of the present invention.

The alternative, the two-part embodiment of the guide stick 22, is disclosed in FIG. 5. In this embodiment, the guide stick 22 is divided into two components, the first upper component 36 comprising the first end 24 and half of the intermediate extent 28, and the second lower component 38 comprising the second end 26 and the other half of the intermediate extent 28. In the preferred embodiment, these two parts (36 and 38) are substantially equal in length, with the upper part 36 being 16 inches in length and the lower part 38 being 15 inches in length. In such an embodiment, the two parts (36 and 38) of the stick 22 are interconnected by way of a sleeve 42. Either half of the intermediate extent 28 would be releasably coupled into the interior of the sleeve 42. In the preferred embodiment, the sleeve 42 has a length of two inches, an outside diameter of ½ inch and an inside diameter of ⅜ inch. A glue or other adhesive could be employed to make this connection permanent. However, as noted above, the preferred embodiment is to manufacture the guide stick 22 from one continuous piece.

The second end of the guide stick 22 is pictured in FIGS. 1 through 3. As illustrated, this second end 26 is formed into a semi-circular guide channel 44 of a first radius. In the preferred embodiment, the radius of this guide channel 44 is 1 and 3/16 inches. Furthermore, as illustrated in FIG. 1, this guide channel 44 is completely offset from the longitudinal axis of the remainder of the stick 22 as well as completely offset from the intermediate extent 28. Thus, when the guide stick 22 is appropriately grasped by a user, the guide channel 44 is offset to the user's left side. Furthermore, as most clearly illustrated in FIG. 5, the guide channel 44 is contained within a plane. With continuing reference to FIG. 5, the plane of the guide channel 44 is slightly offset, or angled, with respect to the longitudinal axis of the stick 22. Additionally, the plane of the guide channel 44 is angled with respect to the plane of the closed loop. Making the guide channel 44 offset and angled enables the user to more readily control the hoop as it travels upon the ground. Furthermore, the offset and angled nature of the channel 44 allow it to be utilized in picking the hoop up off the ground once it has stopped rotating.

The second component to the apparatus of the present invention is the hoop 46. In the preferred embodiment, the hoop 46 is formed from a length of clear Tygon tubing. The tubing has an inside diameter of ½ inch, and an outside diameter of ¾ inch. Tygon is a phthalate plasticized PVC polyvinyl chloride. However, other materials can be used in forming the hoop. Whatever material is employed, the tubing will have a first end 48 and a second end 52, both of which are releasably coupled to one another by a smaller piping element 54. In this manner, the ends can be uncoupled, and the tubing stored in an elongated orientation. In the preferred embodiment, this piping element is formed from Tygon and is two inches in length and with an outside diameter of ½ inch and an inside diameter of ⅜ inch. The manner in which the first and second ends (48 and 52) of the hoop 46 are joined is clearly illustrated with reference to FIG. 4. Such a connection can be employed to releasably join the two ends of the tubing (48 and 52), or the tube can be permanently closed through a fusing process or by the use of standard adhesives. In the preferred embodiment, the closed hoop 46 has an inner diameter of 10 and ¼ inches (5 and ⅛ radius), giving the tube a second predetermined radius of curvature.

In use, the guide stick 22 is employed to both support and to impart motion to the hoop 46. As such, the first and second radii, namely the radius of curvature of the guide channel 44 and the radius of curvature of the hoop 46, are selected to facilitate this interconnection. Thus, a user can grasp the first, or handle, end 24 of the guide stick 22. At this point the guide stick 22 extends downwardly towards the ground. As illustrated in FIG. 2, in use the guide stick 22 will have a slight bend along its length. The guide channel 44 of the stick is then positioned within the hoop 46 with the radius of curvature of the hoop coming into contact with the curvature of the guide channel 44. This configuration is noted in FIG. 1. Thereafter from one foot above the ground the stick and hoop are pushed forward and down. As the hoop hits the ground, the stick is removed. Thereafter, once the hoop 46 is rolling, the user can place the guide channel 44 upon the outer periphery of the hoop 46 at about one-third of the way to the top of the hoop. In this manner, a user can push and otherwise guide the motion of the hoop 46. The location of the guide channel as it is employed in guiding the hoop 46 is noted in phantom in FIG. 2. The stick 22 can also be employed in picking the hoop 46 up off the ground. Specifically, the user can rotate the hoop 46 with his or her feet allowing the guide channel 44 to be positioned upon the inside diameter of the hoop. At this point, the hoop can be picked up or otherwise suspended off the ground.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved amusement apparatus adapted to be manipulated by a user, the apparatus comprising, in combination:

a two-part guide stick being formed from a continuous length of extruded translucent acrylic material having a ⅜ inch diameter, the guide stick being between two and three feet in length and having a longitudinal axis, a first end, a second end, and an intermediate extent therebetween, the guide stick material permitting flexibility between the first and second ends, the first end being folded over within a plane and formed into an elongated closed loop of three inches in length, the intermediate extent having an internal connection piece releasably coupling the two parts of the guide stick, the two parts being substantially equal in length, the second end being formed into a semi-circular guide channel of a first radius, the guide channel being completely offset from the intermediate extent of the guide stick, whereby the guide channel is offset to the user's left side when the guide stick is in use, the guide channel being contained within a plane, the plane of the guide channel being slightly offset from the longitudinal axis of the stick, additionally the plane of the guide channel being angled with respect to the plane of the closed loop;

a hoop being formed from a length of clear Tygon tubing, the tubing having first and second ends which are releasably coupled by a smaller piping element, with the two ends interconnected a closed loop with a second radius is formed; and the first and second radii being selected such that the guide channel of the guide stick can support the hoop as well as be employed to impart rotary motion to the hoop.

2. An amusement apparatus adapted to be manipulated by a user, the apparatus comprising:

a guide stick formed from a continuous length of extruded plastic material and having a first end, a second end, and an intermediate extent therebetween, the guide stick material permitting flexibility between the first and second ends, the second end being formed into a semi-circular guide channel of approximately a 1 3/16 inch radius, the guide channel being completely offset from the intermediate extent of the guide stick, whereby the guide channel is offset to the user's side when the guide stick is in use the guide channel being formed in a plane which makes an acute angle with respect to the length of the guide stick;

a length of hollow plastic tubing with two ends which are releasably interconnected by way of a plastic piping element to form a closed loop with approximately a 5 ⅛ inch radius; and the radius of the guide channel and the radius of the hoop being selected such that the guide channel of the guide stick can support the hoop as well as be employed to impart rotary motion to the hoop.

3. The amusement apparatus as described in claim 2 wherein the guide stick is formed of two parts, the intermediate extent having an internal connection piece releasably coupling the two parts of the guide stick.

4. The amusement apparatus as described in claim 2 wherein the guide stick is formed from a length of translucent acrylic material.

5. The amusement apparatus as described in claim 2 wherein the guide stick is between two and three feet in length.

6. The amusement apparatus as described in claim 2 wherein the first end is folded over and formed into an elongated closed loop.

7. An amusement apparatus adapted to be manipulated by a user, the apparatus comprising:

a guide stick formed from a continuous length of extruded material and having a first end, a second end, and an intermediate extent therebetween, the guide stick material permitting flexibility between the first and second ends, the second end being formed into a semi-circular guide channel of a first radius, the guide channel being completely offset from the intermediate extent of the guide stick, whereby the guide channel is offset to the user's left side when the guide stick is in use;

a hoop with two ends which are interconnected forming a closed loop with a second radius; and the first and second radii being selected such that the guide channel of the guide stick can support the hoop as well as be employed to impart rotary motion to the hoop;

wherein the hoop is formed from a length of clear Tygon tubing, the tubing having first and second ends which are releasably coupled by a smaller PVC piping element.

8. The amusement apparatus as described in claim 2 wherein the guide stick has a thickness of ⅜ inch.

9. The amusement apparatus as described in claim 2 wherein the tubing has a diameter of ¾ inch.

* * * * *